US007051820B2

(12) United States Patent
Stirm

(10) Patent No.: US 7,051,820 B2
(45) Date of Patent: May 30, 2006

(54) ROTARY HAMMER

(75) Inventor: Michael Stirm, Gruenwiesenweg (DE)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 10/459,088

(22) Filed: Jun. 11, 2003

(65) Prior Publication Data

US 2004/0026099 A1 Feb. 12, 2004

(30) Foreign Application Priority Data

Jun. 11, 2002 (GB) ..... 0213289.2

(51) Int. Cl.
*B25D 11/04* (2006.01)

(52) U.S. Cl. ..... 173/109; 173/178; 173/201

(58) Field of Classification Search ..... 173/176, 173/178, 109, 104, 201; 192/56.1, 56.5, 192/55.1, 56.6, 150; 464/35, 30
See application file for complete search history.

(56) References Cited

U.S. PATENT DOCUMENTS 2,065,244 A * 12/1936 Richards ..... 192/56.1
2,263,709 A * 11/1941 Sittert ..... 192/56.1
3,552,147 A * 1/1971 Johansson et al. ..... 192/56.1
3,727,432 A 4/1973 Eaves et al.
3,809,168 A 5/1974 Fromm
3,937,036 A 2/1976 Sauerwein
4,006,785 A 2/1977 Roll et al.
4,071,092 A * 1/1978 Wallace ..... 173/178
4,236,588 A 12/1980 Molden et al.
4,265,320 A 5/1981 Tanaka et al.
4,365,962 A 12/1982 Regelsberger
4,383,454 A 5/1983 Calabrese
4,386,689 A * 6/1983 Kato ..... 464/36
4,429,775 A * 2/1984 Teramoto ..... 173/178
4,529,044 A 7/1985 Klueber et al.
4,719,976 A 1/1988 Bleicher et al.
4,732,217 A 3/1988 Bleicher et al.
4,871,033 A 10/1989 Odoni et al.
4,895,212 A 1/1990 Wache
4,967,888 A 11/1990 Lippacher et al.
5,005,684 A 4/1991 Fujii
5,277,259 A 1/1994 Schmid et al.
5,337,835 A 8/1994 Bohne et al.
5,372,206 A * 12/1994 Sasaki et al. ..... 173/178
5,373,905 A * 12/1994 Bleicher et al. ..... 173/109
5,379,848 A 1/1995 Rauser
5,456,324 A 10/1995 Takagi et al.

(Continued)

FOREIGN PATENT DOCUMENTS

DE 38 07 308 A 9/1989

(Continued)

*Primary Examiner*—Scott A. Smith
(74) *Attorney, Agent, or Firm*—Michael P. Leary; Charles E. Yocum; Adan Ayala

(57) ABSTRACT

An electrically powered rotary hammer comprising a rotary drive mechanism including a spindle drive gear rotatably mounted around the spindle for rotationally driving the spindle, or a part of the spindle, via an overload clutch. The overload clutch is arranged such that below a predetermined torque threshold a spring element or elements maintain(s) the spindle drive gear and a clutch ring in a relative rotational position in which the spindle drive gear locks locking member or members in a first position and such that above the torque threshold the spring element or elements deform(s) and the relative rotational position of the spindle drive gear and a clutch ring changes so that the locking member or members move(s) out of the first position.

16 Claims, 2 Drawing Sheets

U.S. PATENT DOCUMENTS 5,588,496 A * 12/1996 Elger ..... 173/178
5,616,080 A 4/1997 Miescher
5,778,989 A * 7/1998 Neumaier ..... 173/178
5,842,527 A 12/1998 Arakawa et al.
5,947,210 A 9/1999 Sasaki et al.
5,947,214 A 9/1999 Tibbitts
6,015,017 A 1/2000 Lauterwald
6,035,945 A 3/2000 Ichijyou et al.
6,142,242 A 11/2000 Okumura et al.
6,176,321 B1 1/2001 Arakawa et al.
6,192,996 B1 2/2001 Sakaguchi et al.
6,223,833 B1 5/2001 Thurler et al.
6,237,699 B1 5/2001 Plietsch et al.
6,523,658 B1 * 2/2003 Furuta et al. ..... 173/178

FOREIGN PATENT DOCUMENTS

EP 0 375 917 A 7/1990

* cited by examiner

ROTARY HAMMER

The present invention relates to a rotary hammer, and in particular to a rotary hammer incorporating an overload clutch arrangement.

BACKGROUND OF THE INVENTION

Such hammers will normally have a housing and a hollow cylindrical spindle mounted in the housing. The spindle allows insertion of the shank of a tool or bit, for example a drill bit or a chisel bit, into the front end thereof so that it is retained in the front end of the spindle with a degree of axial movement. The spindle may be a single cylindrical part or may be made of two or more co-axial cylindrical parts, which together form the hammer spindle. For example, a front part of the spindle may be formed as a separate tool holder body for retaining the tool or bit.

Such hammers are provided with an impact mechanism which converts the rotational drive from an electric motor to a reciprocating drive for driving a piston, which may be a hollow piston, to reciprocate within the spindle. The piston reciprocatingly drives a ram by means of a closed air cushion located between the piston and the ram. The impacts from the ram are transmitted to the tool or bit of the hammer, optionally via a beatpiece.

Rotary hammers can be employed in combination impact and drilling mode, and also in some cases in a drilling only mode, in which the spindle, or a forwardmost part of the spindle, and hence the bit inserted therein will be caused to rotate. In the combination impact and drilling mode the bit will be caused to rotate at the same time as the bit receives repeated impacts. A rotary drive mechanism transmits rotary drive from the electric motor to the spindle to cause the spindle, or a forwardmost part thereof to rotate.

Rotary hammers are known to have overload clutches in the drive train which transmits rotary drive from the motor to the spindle, or forwardmost part of the spindle. Such overload clutches are designed to transmit rotary drive when the transmitted drive torque is below a predetermined threshold and to slip when the transmitted drive torque exceeds the threshold. During rotary hammering or drilling, when working on materials of non-uniform hardness, for example aggregate or steel reinforced concrete, the bit can become stuck, which causes the torque transmitted via the rotary drive train to increase and causes the hammer housing to tend to rotate against the grip of the user. The torque can increase rapidly and in some cases the user can lose control of the hammer. The use of an overload clutch, can reduce the risk of this occurring, by ensuring that the clutch slips and rotary drive to the bit is interrupted at a torque threshold below that where a user is likely to lose control of the hammer. Accordingly, the clutch must slip reliably at a predetermined torque throughout the lifetime of the hammer, even after sustained use of the hammer.

It is known in some designs of hammer to locate the overload clutch around the spindle of the hammer as part of a spindle drive gear assembly. This generates a relatively compact design of overload clutch. The compactness of a rotary hammer is a critical design feature, in particular for smaller sizes of rotary hammer. The spindle drive gear is rotatingly driven by the motor pinion or by an intermediate shaft driven by the motor pinion and rotary drive is transmitted from the spindle drive gear to the spindle, or a forwardmost part of a spindle via the overload clutch.

In such a known design of overload clutch, the spindle drive gear is rotatably mounted on the spindle and a set of teeth on a side face of the spindle drive gear are engageable with a set of teeth on a facing side face of a clutch ring. The clutch ring is non-rotatably but axially slideably mounted on the spindle and is biased axially along the spindle into engagement with the spindle drive gear by a spring so that the sets of teeth engage. The spring is generally a strong helical spring which extends around the spindle over an axial distance between the clutch ring at one end of the spring and an end stop at the opposite end of the spring against which the spring bears. Below a predetermined threshold, the teeth are biased into engagement by the spring and torque is transmitted from the spindle drive gear to the spindle via the clutch ring. Above the predetermined torque the clutch ring can move against the force of the spring, and the sets of teeth ride over each other, and so the torque from the spindle drive gear is not transmitted to the spindle. Due to the axial movement of the clutch ring and the axially extending spring and the requirement for an end stop for the spring, this known overload clutch arrangement is not very compact and extends over a relatively long axial portion of the spindle. This problem with compactness is exacerbated where a spindle drive gear assembly incorporating such an overload clutch is arranged as a sub-assembly which sub-assembly can be moved axially along the spindle in order to move the spindle drive gear between different mode positions. In one mode position, for drilling only and/or rotary hammering, the spindle drive gear will mesh with the shaft or pinion which drives it and the spindle is rotated. In a second mode position, for hammering only, the spindle drive gear is moved axially along the spindle and out of engagement with the shaft or pinion and drive to the spindle is stopped.

BRIEF DESCRIPTION OF THE INVENTION

The present invention aims to provide a compact and reliable design of overload clutch for a rotary hammer, which overcomes at least some of the problems discussed above.

According to the present invention there is provided an electrically powered rotary hammer comprising a hollow cylindrical spindle mounted rotatably within a housing of the hammer with a tool holder arrangement located at a forward end of the spindle for releasably holding a tool or bit within a forward tool holder portion of the spindle so as to enable limited reciprocation of the tool or bit within the spindle; an air cushion hammering mechanism located within the spindle for generating repeated impacts on the tool or bit; and a rotary drive mechanism comprising a spindle drive gear mounted rotatably around the spindle for rotationally driving the spindle, or a part of the spindle, via an overload clutch, characterised in that the overload clutch comprises:

- a clutch ring rotatably mounted around the spindle so as to have limited rotational movement with respect to the spindle drive gear and so as to be rotatably driven by the spindle drive gear via at least one spring element; and
- at least one locking member carried by the clutch ring so as to be shiftable with respect to the clutch ring from a first position in which the locking member transmit rotary drive from the clutch ring to the spindle;
- arranged such that below a predetermined torque threshold the spring element or elements maintain(s) the spindle drive gear and the clutch ring in a relative rotational position in which the spindle drive gear locks the locking member or members in the first position and such that above the torque threshold the spring element or elements deform(s) and the relative rotational position of the spindle drive gear and the clutch ring changes so that the locking member or members move(s) out of the first position.

In a particularly axially compact design, the clutch ring is located, preferably radially, between the spindle drive gear and the spindle. Also, the locking member or member(s) may be carried by the clutch ring so as to be radially shiftable between a radially inner first position and a radially outer second position.

For compactness and accurate determination of the torque threshold, preferably the or each spring element extends in a circumferential direction between a stop on the spindle drive gear and a first stop on the clutch ring. The relative rotational position of the spindle drive gear and the clutch ring may be maintained by the or each spring element urging an associated stop on the spindle drive gear into abutting engagement with a corresponding second stop on the clutch ring. The stop on the spindle drive gear may extend radially inwardly of a radially inward facing surface of the spindle drive gear and the first and second stops on the clutch ring may extend radially outwardly of a peripheral surface of the clutch ring.

In a preferred design, a recess is formed in the spindle drive gear for each locking element and the or each locking elements move(s) into the associated recess(es) when moving out of the first position. The or each recess may be formed in a radially inwardly facing surface of the spindle drive gear.

For good guidance of the locking members, the clutch ring may comprises a pocket for each locking element. Each pocket may be formed with a rim of increased radial width, which rim forms the first stop and additionally or alternatively the second stop of the clutch ring.

The spindle may be formed with a recess for the or each locking element and the or each locking element engages a corresponding recess in the first position of the locking element(s) in order to simply and reliably transmit torque between the clutch ring and the spindle. Alternatively, where the spindle drive gear and overload clutch are axially slideable on the spindle, in order to engage and disengage rotary drive to the spindle, an axially slideable sleeve, on which the spindle drive gear and overload clutch are mounted, which sleeve is arranged to rotatably drive the spindle is formed with a recess for the or each locking element and the or each locking element engages a corresponding recess in the first position of the locking element(s). The or each recess may be formed in a radially outwardly facing surface of the spindle or sleeve.

In a preferred design the resilient member or members maintain the spindle drive gear and the clutch ring in a relative rotational position in which the or each recess in the spindle drive gear is radially mis-aligned with the or a corresponding one of the recesses in the spindle or sleeve.

According to a preferred embodiment of the present invention that is relatively radially compact, the teeth of the spindle drive gear are located axially forwardly or axially rearwardly of the clutch ring.

BRIEF DESCRIPTION OF THE DRAWINGS

One form of rotary hammer according to the present invention will now be described by way of example with reference to the accompanying drawings in which.

DETAILED DESCRIPTION OF THE INVENTION

Figures 1, 4:
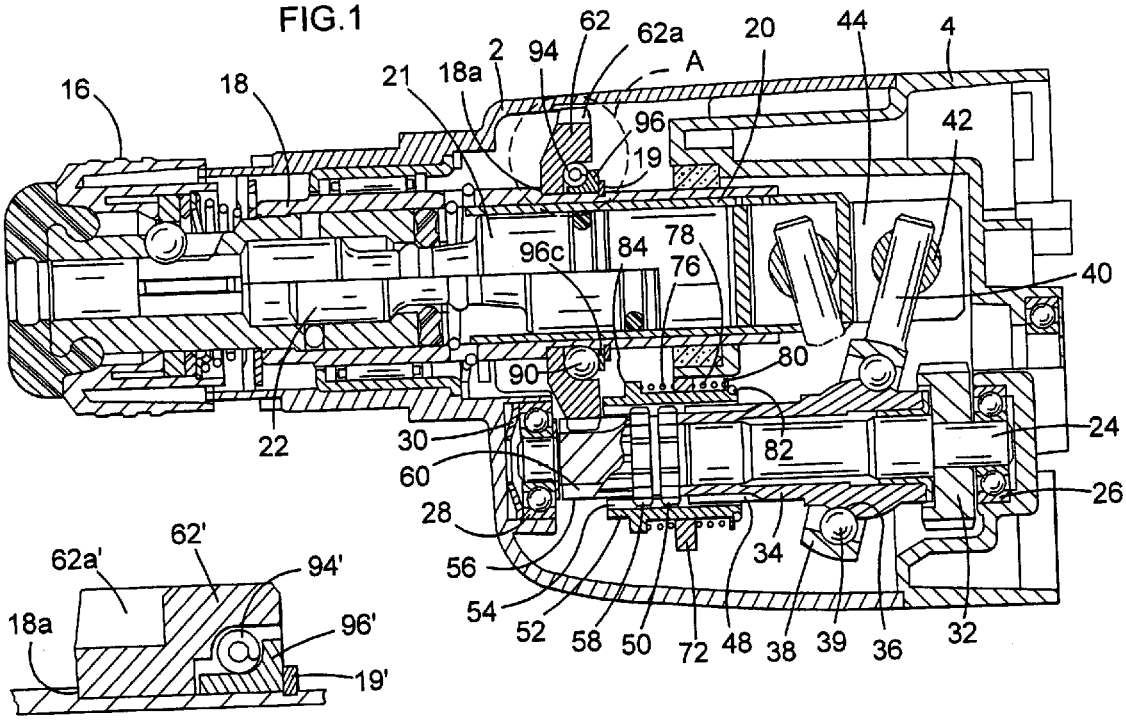
FIG. 1 shows a longitudinal cross section though the forward part of a rotary hammer, when the rotary hammer is in drilling only mode.
FIG. 4 is a longitudinal cross-section equivalent to the area A of FIG. 1 showing a second embodiment of the present invention.

The rotary hammer has a forward portion which is shown in FIG. 1 and a rearward portion incorporating a motor and a rear handle, in the conventional way. The handle may be of the pistol grip or D-handle type. The handle portion incorporates a trigger switch for actuating the electric motor, which motor is formed at the forward end of its armature shaft with a pinion (not shown). In the FIG. 1 arrangement the longitudinal axis of the motor is parallel with the longitudinal axis of the hollow cylindrical spindle (18) of the hammer. Alternatively, the motor could be aligned with its axis perpendicular to the axis of the spindle (18), in which case a bevel pinion would be formed at the end of the armature shaft of the motor, to mesh with a bevel gear press fit on the intermediate shaft replacing the gear (32). The rotary hammer of FIG. 1 has a forward housing part (2) and a central housing part (4) which are fixed together by screw members (not shown) to form a housing for the hammer spindle (18), spindle drive arrangement, hammer drive arrangement and mode change mechanism.

The hammer has a spindle (18) which is mounted for rotation within the hammer housing (2, 4) as is conventional. Within the rear of the spindle is slideably located a hollow piston (20) as is conventional. The hollow piston (20) is reciprocated within the spindle (18) by a hammer drive arrangement which is described in more detail below. A ram (21) follows the reciprocation of the piston (20) in the usual way due to successive under-pressures and over-pressures in an air cushion within the piston between the piston (20) and the ram (21). The reciprocation of the ram causes the ram to repeatedly impact a beatpiece (22) which itself repeatedly impacts a tool or bit (not shown). The tool or bit is releasably secured to the hammer by a tool holder of conventional design, such as an SDS-Plus type tool holder (16). The tool holder allows the tool or bit to reciprocate within it to transfer the forward impact of the beatpiece to a surface to be worked (such as a concrete block). The tool holder (16) also transmits rotary drive from the spindle (18) to the tool or bit secured within it.

The hammer is driven by a motor not shown, which has a pinion (not shown) which rotatingly drives an intermediate shaft (24) via a drive gear (32). The intermediate shaft is mounted for rotation within the hammer housing (2, 4), parallel to the hammer spindle (18) by means of rearward bearing (26) and forward bearing (28). The intermediate shaft has a driving gear (50) either integrally formed on it or press fitted onto it so that the driving gear rotates with the intermediate shaft (24). Thus, whenever power is supplied to the motor the driving gear (50) rotates along with the intermediate shaft (24).

The hammer drive arrangement comprises a wobble sleeve (34) which is rotatably mounted on the intermediate shaft (24) and which has a wobble race (36) formed around it at an oblique angle to the axis of the intermediate shaft (24). A wobble ring (38) from which extends a wobble pin (40) is mounted for rotation around the wobble race (36) via ball bearings (39) in the usual way. The end of the wobble pin (40) remote from the wobble ring (38) is mounted through an aperture in a trunnion pin (42) which trunnion pin is pivotally mounted to the rear end of the hollow piston (20) via two apertured arms (44). Thus, when the hammer drive sleeve is rotatably driven about the intermediate shaft the wobble drive (36, 38, 39, 40, 42, 44) reciprocatingly drives the hollow piston in a conventional manner. The wobble sleeve (34) has a set of driven splines (48) provided at the forward end of the sleeve (34). The driven splines (48) are selectively engageable with the intermediate shaft driving gear (50) via a mode change sleeve (52). When the intermediate shaft is rotatably driven by the motor pinion and the mode change sleeve (52) engages the driving splines (48) of the hammer drive sleeve (34), the driving gear (50) rotatably drives the hammer drive sleeve (34), the piston (20) is reciprocatingly driven by the wobble drive and a tool or bit mounted in the tool holder (16) is repeatedly impacted by the beatpiece (22) via the action of the ram (21).

The spindle drive arrangement comprises a spindle drive sleeve (56) which is mounted for rotation with respect to the intermediate shaft (24). The spindle drive sleeve comprises a set of driving teeth (60) at its forward end which are permanently in engagement with the teeth (62*a*) of spindle drive gear (62). The spindle drive gear (62) is mounted on the spindle (18) via an overload clutch arrangement, which is described below. Thus, when the spindle drive sleeve (56) is rotatably driven the spindle (18) is rotatably driven and this rotary drive is transferred to a tool or bit via the tool holder (16). The spindle drive sleeve (56) has a driven gear (58) located at its rearward end which can be selectively driven by the intermediate shaft driving gear (50) via the mode change sleeve (52).

In the position shown in FIG. 1 axially extending teeth (54) formed in the radially inward facing surface of the mode change sleeve (52) straddle the intermediate shaft driving gear (50) and the spindle drive sleeve driven teeth (58). Thus rotational drive is transmitted to the spindle and drilling mode is achieved. The mode change sleeve can be moved rearwardly from its position in FIG. 1 into an intermediate position in which the teeth (54) of the spindle drive sleeve straddle the intermediate shaft driving gear (50), the spindle drive sleeve driven teeth (58) and the driven splines (48) of the wobble sleeve (34). Thus, rotational drive is transmitted to the spindle and to the wobble sleeve and hammer drilling mode is achieved. The mode change sleeve can be moved rearwardly from its intermediate position into a rearward position in which the teeth (54) of the spindle drive sleeve straddle the intermediate shaft driving gear (50) and the driven splines (48) of the wobble sleeve (34). Thus, rotational drive is transmitted to the wobble sleeve and hammer only mode is achieved.

Figure 2:
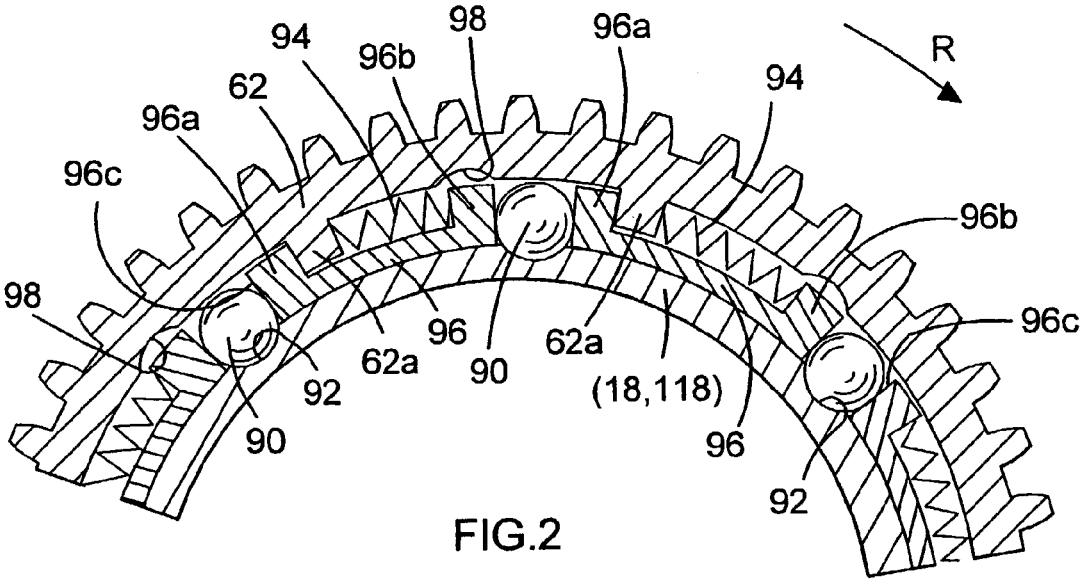
FIG. 2 shows a transverse cross section though a part of the overload spindle clutch of the hammer of FIG. 1, when the clutch is transmitting torque to the spindle.
Figure 3:
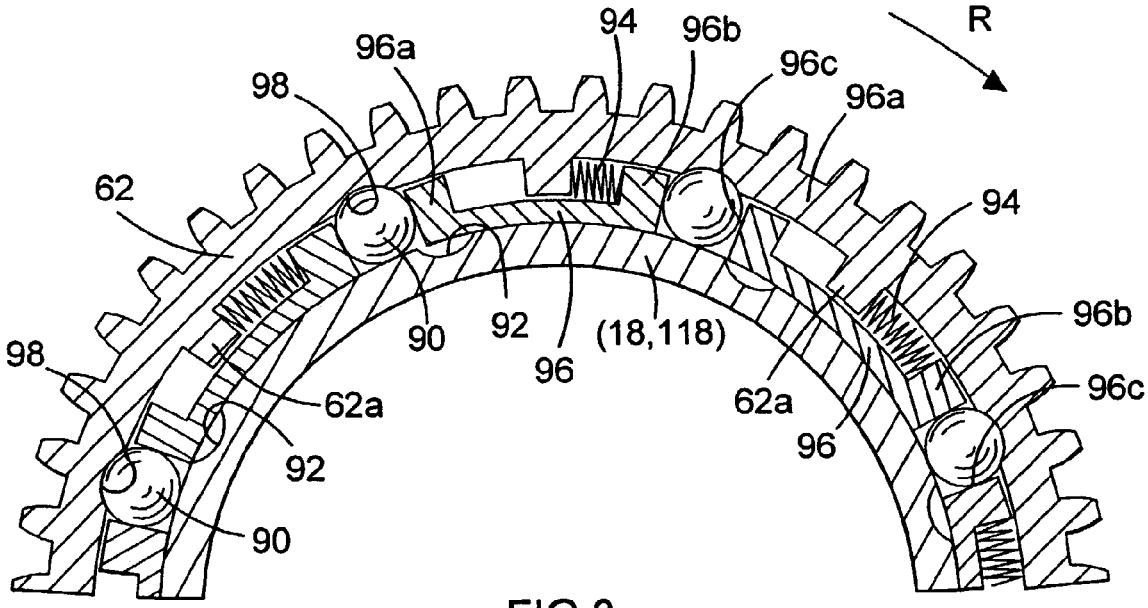
FIG. 3 shows a transverse cross section though a part of the overload spindle clutch of the hammer of FIG. 1, when the clutch is slipping.

The spindle drive gear (62) rotationally drives the spindle (10) via the overload spindle clutch shown in FIGS. 2 and 3. The spindle drive gear (62) is mounted around the spindle (18) so as to be able to rotate with respect to the spindle. Axial forward movement of the spindle drive gear (62) is limited by a rearwardly facing shoulder (18*a*) formed in the outer surface of the spindle (18). A clutch ring (96) is also rotatably mounted on the spindle, and axially rearward movement of the clutch ring (96) is prevented by circlip (19). Thus, axial movement of the overload spindle clutch components is prevented by their location between the shoulder (18*a*) and circlip (19).

FIG. 2 shows the engaged position of the clutch, below the predetermined torque threshold. The spindle drive gear (62) drives the clutch ring (96) in the direction of rotation (R), via a plurality of helical springs (94). A plurality pegs (62*a*) project radially inwardly of the radially inward facing surface of the spindle drive gear (62) which pegs (62*a*) abut the trailing end (with respect to the direction of rotation (R)) of an associated spring (94). The leading end (with respect to the direction of rotation (R)) of each spring (94) abuts an associated second peg (96*b*), which plurality of second pegs (96*b*) extend radially outwardly of the peripheral surface of the clutch ring (96). Each spring (94) is located so as to each extend circumferentially between the associated pegs (62*a*, 96*b*) between a radially inward facing surface of the spindle drive gear (62) and peripheral surface sections of the clutch ring (96).

Each radially inward extending peg (62*a*) of the spindle drive gear (62) is circumferentially located between an associated first peg (96*a*) to the trailing edge side of the peg (62*a*) and an associated second peg (96*b*) to the leading edge side of the peg (62*a*). In this way relative rotation between the spindle drive gear (62) and the clutch ring (96) is limited.

The clutch ring (96) rotationally drives the spindle (18) via a plurality of locking elements, in the form of rolling locking balls (90). The locking balls (90) are located within pockets (96*c*) formed in the clutch ring (96). The pockets are (96*c*) open in the axial direction of the spindle drive gear (62), as can be seen from FIG. 1, so that the balls (90) are positioned on the spindle (18), against axial movement, between the pocket (96*c*) of the clutch ring (96) to the rearward side and a radially inward part of the spindle drive gear (62) at the forward side. Each radially outwardly projecting second peg (96*b*) is formed at the trailing edge of an associated pocket (96*c*) and so abut the trailing end of an associated ball (90). Each pocket (96*c*) is also formed with a radially outwardly projecting first peg (96*a*) which the leading edge of each ball (90) abuts. The peripheral surface of the spindle (18) is formed with a set of pockets (92), for receiving the associated balls (90), when the clutch is engaged, as described below. A radially inward facing surface of the spindle drive gear (62) is formed with a set of pockets (98), for receiving the associated balls (90), when the clutch slips, as described below.

As shown in FIGS. 1 and 2, below the predetermined torque threshold, the springs (94) urge the first pegs (96*a*) of the clutch ring (96) to abut the pegs (62*a*) of the spindle drive gear (62). This acts to move pockets (98) in the spindle drive gear (62) out of alignment with the pockets (96*c*) of the clutch ring (96). Thus, the balls cannot engage the pockets (98) in the spindle drive gear. Instead the balls (90) are urged into engagement with associated pockets (92) in the spindle, as is shown in FIGS. 1 and 2. Therefore, in the engaged position of the overload clutch, as shown in FIGS. 1 and 2, rotary drive in the direction (R) is transmitted from the spindle drive gear (62) to the clutch ring (96) via the springs (94) and from the clutch ring (96) to the spindle (18) via the locking balls (90), and the spindle is rotatingly driven.

When the torque increases above the predetermined threshold, the rotary driving force from the spindle drive gear (62) causes the springs (94) to be compressed. The compression of the springs (94) enables the spindle drive gear (62) to move with respect to the clutch ring (96) in the direction of rotation (R) until the pockets (98) in the spindle drive gear (62) become aligned with the pockets (96*c*) in the clutch ring (96), ie. the pockets (98) become aligned with the locking balls (90). The locking balls (90) are urged radially outwardly by the driving force from them to the spindle (18) and move into the pockets (98) in the spindle drive gear (62). Thereafter, the spindle drive gear (62) and clutch ring (96) freely rotate around the spindle and rotary drive to the spindle is stopped. This, slipping position of the overload clutch is shown in FIG. 3.

When the torque again decreases to below the predetermined threshold, the springs (94) urge the spindle drive gear (62) to rotate with respect to the clutch ring (96) in a direction opposite to the direction of rotation. Then as soon as the set of pockets (92) in the spindle (18) next become aligned with the pockets (96*c*) in the clutch ring (96), the locking balls are urged, under the force of the springs (94) radially inwardly out of the pockets (98) in the spindle drive gear (62) and into the pockets (92) in the spindle (18) and the pegs (96*a*) and (62*a*) are urged to abut once more. Thus, the overload clutch arrangement once more assumes its engaged position of FIGS. 1 and 2 in which it transmits rotary drive from the spindle drive gear (62) to the spindle (18).

As can be seen from the Figures, the overload clutch arrangement is compact, in particular in the axial direction.

In some designs of hammers having a different mode change mechanism to that described above, the rotary drive to the spindle (18) is disconnected by moving the spindle drive gear (62) axially along the spindle and out of engagement with a driving pinion formed on the intermediate shaft (24). The overload clutch arrangement described above, according to the present invention is also suitable for use when transmitting rotary drive from such an axially moveable spindle drive gear (62) to the spindle (18). In this case the spindle drive gear (62) and clutch ring (96) is rotatably and axially fixedly mounted on a slider sleeve (118). The slider sleeve (118) is formed with the pockets (92) for receiving the locking balls (90), as shown in FIGS. 2 and 3. The slider sleeve (118) is non-rotatably and axially slideably mounted on the spindle (18). Therefore, below the torque threshold, the overload clutch arrangement rotationally drives the slider sleeve (118), which slider sleeve (118) rotationally drives the spindle. Above the torque threshold the overload clutch slips and so no rotary drive is transmitted to the slider sleeve (118) and so no rotary drive is transmitted to the spindle (18). In mode positions of the hammer, such as hammer drilling and drilling only, the slider sleeve (118), on which the overload clutch and spindle drive gear arrangement is mounted, is axially moved to a position on the spindle in which the spindle drive gear (62) is rotatingly driven by the intermediate shaft (24). In mode positions of the hammer, such as hammer only mode, the slider sleeve (118) is axially moved to a position on the spindle in which the spindle drive gear (62) is moved out of engagement the intermediate shaft (24) and so is not rotatingly driven.

FIG. 4 shows an alternative embodiment of the present invention, with like parts identified with like numerals designated with a '. The embodiment of FIG. 4 has a differently configured spindle drive gear (62') with the teeth (62*a*') of the spindle drive gear located axially forwardly of the clutch ring (96'), this enables the spindle drive gear (62') to have a smaller outer radius. In the FIG. 1 embodiment, the teeth (62*a*) are located radially outwardly of the clutch ring (96) and so the FIG. 4 embodiment is radially more compact.

The invention claimed is:

1. An electrically powered rotary hammer comprising:

a hollow cylindrical spindle mounted rotatably within a housing of the hammer with a tool holder arrangement located at a forward end of the spindle for releasably holding a tool or bit so as to enable limited reciprocation of the tool or bit;

an air cushion hammering mechanism located within the spindle for generating repeated impacts on the tool or bit; and a rotary drive mechanism comprising a spindle drive gear mounted rotatably around the spindle for rotationally driving the spindle via an overload clutch, characterised in that the overload clutch comprises:

a clutch ring rotatably mounted around the spindle so as to have limited rotational movement with respect to the spindle drive gear and so as to be rotatably driven by the spindle drive gear via at least one spring element; and at least one locking member carried by the clutch ring so as to be shiftable with respect to the clutch ring from a first position, in which the locking member transmits rotary drive from the clutch ring to the spindle, to a second position wherein the locking member does not transmit rotary drive to the spindle;

arranged such that below a predetermined torque threshold the spring element maintains the spindle drive gear and the clutch ring in a first relative rotational position in which the spindle drive gear locks the locking member in the first position and such that above the torque threshold the spring element deforms and the spindle drive gear and the clutch ring move into a second relative rotational position wherein the locking member moves into the second position.

2. A hammer according to claim 1 wherein the clutch ring is located radially between the spindle drive gear and the spindle.

3. A hammer according to claim 1 wherein the locking member is radially shiftable between the first position and the second position.

4. A hammer according to claim 1 wherein the spring element extends between a stop on the spindle drive gear and a first stop on the clutch ring.

5. A hammer according to claim 4 wherein the first relative rotational position of the spindle drive gear and the clutch ring is maintained by the spring element urging the stop on the spindle drive gear into abutting engagement with a second stop on the clutch ring.

6. A hammer according to claim 5 wherein the stop on the spindle drive gear extends radially inwardly of a radially inward facing surface of the spindle drive gear and the first stop and the second stop on the clutch ring extend radially outwardly of a peripheral surface of the clutch ring.

7. A hammer according to claim 1 wherein the spindle drive gear defines a recess and the locking member moves into the recess when shifted into the second position.

8. A hammer according to claim 7 wherein the recess is defined by a radially inward facing surface of the spindle drive gear.

9. A hammer according to claim 7 further including a resilient member connected between the spindle drive gear and the clutch ring and wherein the spindle defines a recess which the locking member engages when in the first position, and the resilient member biases the spindle drive gear and the clutch ring into the first relative rotational position in which the recess in the spindle drive gear is radially miss-aligned with the recess in the spindle.

10. A hammer according to claim 7 and further including a sleeve for rotatably driving the spindle and a resilient member connected between the spindle drive gear and the clutch ring, and wherein the sleeve defines a recess, and wherein the resilient member biases the spindle drive gear and the clutch ring into the first relative rotational position in which the recess in the spindle drive gear is radially miss-aligned with the recess in the sleeve.

11. A hammer according to claim 1 wherein the clutch ring comprises a pocket for engaging the locking member.

12. A hammer according claim 1 wherein the spindle defines a recess and the locking member engages the recess when in the first position.

13. A hammer according to claim 1, and further including a sleeve for rotatably driving the spindle, the sleeve defining a recess and the locking member engages the recess in the first position.

14. A hammer according to claim 12 wherein the recess is formed in a radially outward facing surface of the spindle.

15. A hammer according to claim 13 wherein the recess is formed in a radially outwardly facing surface of the sleeve.

16. A hammer according to claim 1 wherein the spindle drive gear includes teeth formed one of axially forward of the clutch ring and axially rearward of the clutch ring.

* * * * *